US005499406A

United States Patent [19]

Chalberg et al.

[11] Patent Number: 5,499,406

[45] Date of Patent: Mar. 19, 1996

[54] SAFETY SUCTION ASSEMBLY FOR USE IN WHIRLPOOL BATHS AND THE LIKE

[75] Inventors: Philip E. Chalberg; Paul N. Kenchel, both of Costa Mesa, Calif.

[73] Assignee: Hydrabaths, Inc., Santa Ana, Calif.

[21] Appl. No.: 353,664

[22] Filed: Dec. 12, 1994

[51] Int. Cl.[6] ..... A47K 3/00; E04H 4/12

[52] U.S. Cl. ..... 4/541.2; 4/504; 417/151; 417/160

[58] Field of Search ..... 4/541.2, 504, 507, 4/541.1, 541.3, 541.4; 417/77, 151, 160, 179

[56] References Cited

U.S. PATENT DOCUMENTS 4,115,878 9/1978 Johnson et al. ..... 4/492

4,602,391 7/1986 Shepherd ..... 4/504 X 5,167,041 12/1992 Burkitt ..... 4/541.2

5,347,664 9/1994 Hamza et al. ..... 4/541.2 X

*Primary Examiner*—Charles E. Phillips

*Attorney, Agent, or Firm*—Leonard Tachner

[57] ABSTRACT

A suction assembly employs an air induction tube to induct air into the recirculating water pump to cause the pump to cease pumping operation when the front face of the assembly is blocked. The induction tube is connected to a bleed path formed between the induction tube and a surrounding coaxial face tube extended into the assembly from the front face. When the face is blocked by hair or the like, water in the induction tube bleeds into the main chamber of the assembly and empties the induction tube. Air is then pulled into the pump, causing the pump to lose prime thereby reducing pump pressure to zero and allowing the hair or other blocking material to be removed.

10 Claims, 5 Drawing Sheets

SAFETY SUCTION ASSEMBLY FOR USE IN WHIRLPOOL BATHS AND THE LIKE

BACKGROUND OF THE INVENTION

1. Field of the Invention

The present invention relates generally to the field of spas and whirlpool baths and more specifically to a suction fitting component thereof, which is designed to prevent serious accidents resulting from the trapping of hair and the like which can result in drowning.

2. Prior Art

Whirlpool baths and spas commonly use a plurality of venturi-type jets which mix air and water and propel the combination into a tub filled with water. A pump is normally used to suction water from the interior of the tub and force it through the jets which employ the well-known venturi effect to entrap air as well, to create a bubble-type forceful spray of water for massage and the like. In order to facilitate the withdrawal of the water from the tub by the pump, whirlpool baths are provided with what is called a suction fitting which is positioned within a hole in the wall of the tub at a height below the water surface and which is connected to the pump inlet so that the force of the pumping action sucks the water out of the tub through the hole and the fitting. Typically, the face of the fitting, which is readily visible in the interior of the tub, is configured to provide a protective covering that has a plurality of small apertures. Such a configuration allows water to be sucked through the small apertures of the suction fitting, but attempts to prevent hair and body parts, such as elbows and the meaty part of the body from being sucked into the suction fitting which may hold the individual against the wall adjacent the suction fitting and cause an accident or other discomfort.

Unfortunately, it has been found that even with the small orifices in the cover of the suction fitting, accidents can still happen and in fact, do happen, some resulting in drowning. Such accidents may result from the trapping of hair of an individual whose head is below the surface of the water. The hair may be sucked through the small apertures and be trapped in the suction fitting, thereby preventing the person whose hair is trapped, from being able to stand and remove his head from adjacent the suction fitting. This severe problem of a potential drowning accident has resulted in certain attempts to solve that problem by divising systems which sense the blockage of the suction fitting cover and turn off the pump when that occurs, so that the negative suction pressure falls to zero, the hair can be released and the person can stand and avoid accidental drowning. An example of such prior art is disclosed in U.S. Pat. No. 5,167,041 to Burkitt. The Burkitt patent discloses a suction fitting having a suction line connected to the pump for circulating the water in the tub and also having a pressure sensor line connecting to a water level sensor, which is, in turn connected to the pump control which is connected to the pump for turning it on and off in response to the level sensor. The water level sensor is a float assembly having a float which moves up and down within a chamber, the float's motion being determined by the water level in the tub when the suction assembly is unblocked. On the other hand, when the face of the suction assembly is blocked, a plurality of slots in the protective cover permits the suction effect of the pump to pull water through those slots. The water exits from the sensor line, thereby reducing the water level in the float chamber, activating a switch, which in turn turns off the pump, thereby reducing the suction level to zero and permitting the blockage to be removed. While the Burkitt disclosure describes a device which can overcome the prior art safety hazard described above, it suffers from a number of disadvantages which can still have a significant effect on the actual safety of the device, as well as on other commercially important features of the suction assembly. By way of example, the Burkitt device relies on a plurality of elongated slots in the protective cover of the suction fitting. These slots radiate from the central opening of the suction assembly cover to a plurality of suction openings in the face or cover of the suction fitting, separated from the central opening thereof. Unfortunately, this safety feature assumes that whatever is blocking the face of the suction fitting, will not also block the passage of water within these slots. However, the most common material that may block the face of a suction fitting of the type herein described is human hair and human hair is flexible enough, soft enough and fine enough to also block the slots of the Burkitt device and thus impede the safety function thereof. Furthermore, these slots in the face or cover of the suction fitting of the Burkitt disclosure may detract from the aesthetic appearance of the cover and therefore become unattractive from a commercial standpoint. Furthermore, a safety cover with slots is more difficult to mold in plastic or form in sheet metal and more difficult to plate, such as plating with various coatings, including metal coatings, to give the face a particular metal appearance such as a gold or silver appearance, which is common in the whirlpool bath industry. Furthermore, the Burkitt device is dependent for its proper operation on the use of the float chamber and a pair of switches mounted on the outside of the float chamber, which must operate properly and reliably for the pump to be turned off in response to the position of the float within the chamber. However, it is well-known that switches, particularly magnetic switches, can be unreliable and therefore either cause the safety feature of the Burkitt device to fail or to turn off the pump when there is no reasonable basis for doing so (i.e., even when the face of the suction fitting is not blocked).

Thus, despite the disclosure of U.S. Pat. No. 5,167,041 to Burkitt, there is still a continuing need for a safety device for suction fittings for use in whirlpool baths which overcomes the disadvantages noted above. More specifically, there is still a need for a device which can turn the pump off whenever the face of the suction fitting is blocked, without requiring the use of slots in the tub interior face of the suction fitting, without requiring that the face have special slots which detract from its aesthetic appearance and without requiring that the face have slots which can increase the difficulty of plastic molding or metal forming and plating which can otherwise increase the cost of such devices. Most importantly however, there is still a continuing need for a suction fitting pump turn off mechanism which does not depend on moving parts or potentially unreliable electrical, mechanical or magnetic switches which can either fail to operate when required to or operate when it is unnecessary.

SUMMARY OF THE INVENTION

The present invention meets the aforementioned needs by providing a blockage sensing mechanism for the face of a suction fitting of a whirlpool bath, wherein the face exterior is not slotted or otherwise changed from its nominal configuration and wherein shutdown of pumping action is assured, without the use of electric, magnetic or mechanical components which would otherwise detract from reliability and/or create a risk of false pump turn off which would detract from the overall commercial viability of the suction assembly.

The present invention overcomes these disadvantages by providing at least two significant improvements relative to the Burkitt disclosure of the prior art. More specifically, in the present invention, there is no need for a float chamber or switches. Instead, the present invention utilizes an air induction tube which is connected through the suction assembly to the pump inlet and which is normally filled with water to the level of the water in the tub. However, when the face of the suction fitting is blocked, the water in the induction tube is effectively sucked out, thereby exposing the pump inlet to air. Air is then induced into the water pump, and immediately stops the pump action, reducing the pump negative pressure to zero and thereby permitting the blockage to be removed from the face of the fitting. An additional improvement of the present invention is the use of a suction fitting assembly design which permits the water in the aforementioned induction tube to be sucked out, without requiring any slots in the face of the fitting. This is accomplished by utilizing a safety suction tube and a fluidic diverter body in the interior of the suction fitting assembly which channels the water in the induction tube, into the pump suction portion of the fitting. This channeling of water is done without requiring water in the induction tube to flow through the apertures in the face of the fitting. This unique design obviates the prior art requirement for the slots in the prior art face.

Thus, the present invention meets the requirements for providing a safety device for shutting down the pump when the face of the suction fitting is blocked, but without requiring the prior art slots in the face, which otherwise diminish the level of safety and increase the cost of plastic molding or metal forming and plating the face of the suction fitting and otherwise diminish the aesthetic appearance thereof. Furthermore, the present invention does not require the use of a float chamber, nor of any form of switches required in the prior art.

OBJECTS OF THE INVENTION

It is therefore a principal object of the present invention to provide an improved safety suction assembly for use in whirlpool baths for shutting down the pumping action and thus relieving the suction effect at the interior face of the fitting, whenever the face is blocked, such as by human hair and the like.

It is an additional object of the present invention to provide an improved safety suction fitting assembly for use in whirlpool baths which obviates the prior art requirement for using a special face having slots therein.

It is still an additional object of the present invention to provide an improved safety suction assembly for use in whirlpool baths which effects a total shutdown of the pumping action, whenever the face of the fitting is blocked, the shutdown being accomplished without the use of any switching components which might otherwise reduce the reliability of such a safety device.

It is still an additional object of the present invention to provide an improved safety suction fitting assembly for use in whirlpool baths which effectively shuts the pumping action down whenever the fitting face is blocked, such shutdown being effected by inducing air into the pump and without relying on any moving parts, such as a float assembly or the like.

BRIEF DESCRIPTION OF THE DRAWINGS

The aforementioned objects and advantages of the present invention, as well as additional objects and advantages thereof will be more fully understood hereinafter as a result of a detailed description of preferred embodiments of the invention when taken in conjunction with the following drawings in which.

DETAILED DESCRIPTION OF PREFERRED EMBODIMENTS

Figure 1:
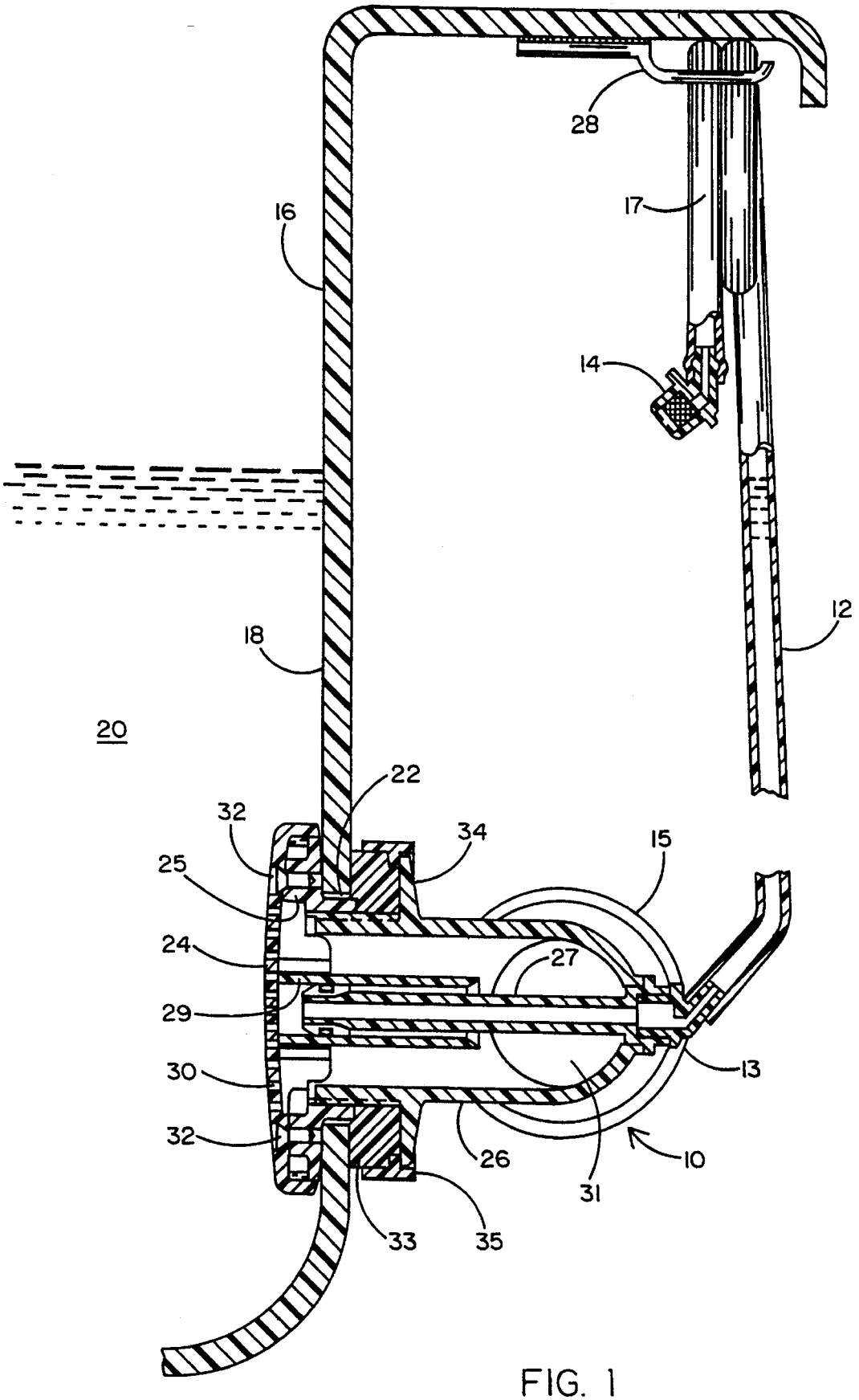
FIG. 1 is a cross-sectional view of a portion of a bath tub illustrating the configuration of an assembly in accordance with the invention installed in an aperture of a tub wall.

Referring initially to FIG. 1, it will be seen that an improved suction assembly 10 of the present invention is affixed to a tub 16 and particularly to the wall 18 thereof, through an aperture 22. The interior of the tub is partially filled with water 20, so that the suction fitting 10 is positioned in the tub wall 18 below the surface of the water. The assembly 10 comprises a body 26, which is connected to a pump inlet connecting pipe 15 and to an induction tube 12, by means of a fitting 13, at the end of a body 26, opposite the tub wall. Induction tube 12 extends upwardly towards the underside surface of the top of tub 16 where it is shaped into a loop 17, terminating at an optional air filter 14 and open to ambient air pressure. A tube holder 28 may be used to secure the loop portion of the induction tube to the interior surface of the tub. It will be understood that the induction tube 12 normally holds a column of water at the same height as the height of water 20 in tub 16 when the pump is not operating. Accordingly, the induction tube extends to the height of the tub 16 and includes the loop 17 in order to prevent water leakage outside of the tube, irrespective of the height of the water 20 within the tub. It will be further understood that due to water system dynamics, a water column is maintained in the induction tube 12 when the suction fitting 10 and pump are operating in a normal manner without blockage of the cover 24.

As seen further in FIG. 1, the suction assembly 10 is installed in the aperture 22 of the tub wall 18 by threading the body 26 to a threaded insert 25 to which in turn, a face or cover 24 is secured by a pair of fasteners such as screws 32. The resistance against leakage is accomplished by utilizing a seal 33 which is positioned immediately behind the aperture 22 in the tub wall 18 and which is compressed against the aperture perimeter by means of flange 34 and ring 35.

As seen further in FIG. 1 and more clearly in FIG. 2, the face or cover 24 provides a plurality of face apertures 30, which as will be seen hereinafter, provide passageways for water within the tub 16, to be sucked through the cover 24 and into the main chamber 31 of the body 26. It will also be seen in FIG. 1, that the cover 24 provides an integral interior extending face tube 29. Tube 29 is in coaxial overlapping relation with an induction stem or chamber 27 which extends axially and centrally within the body 26 toward the fitting 13 at the rear of the body.

Figure 2:
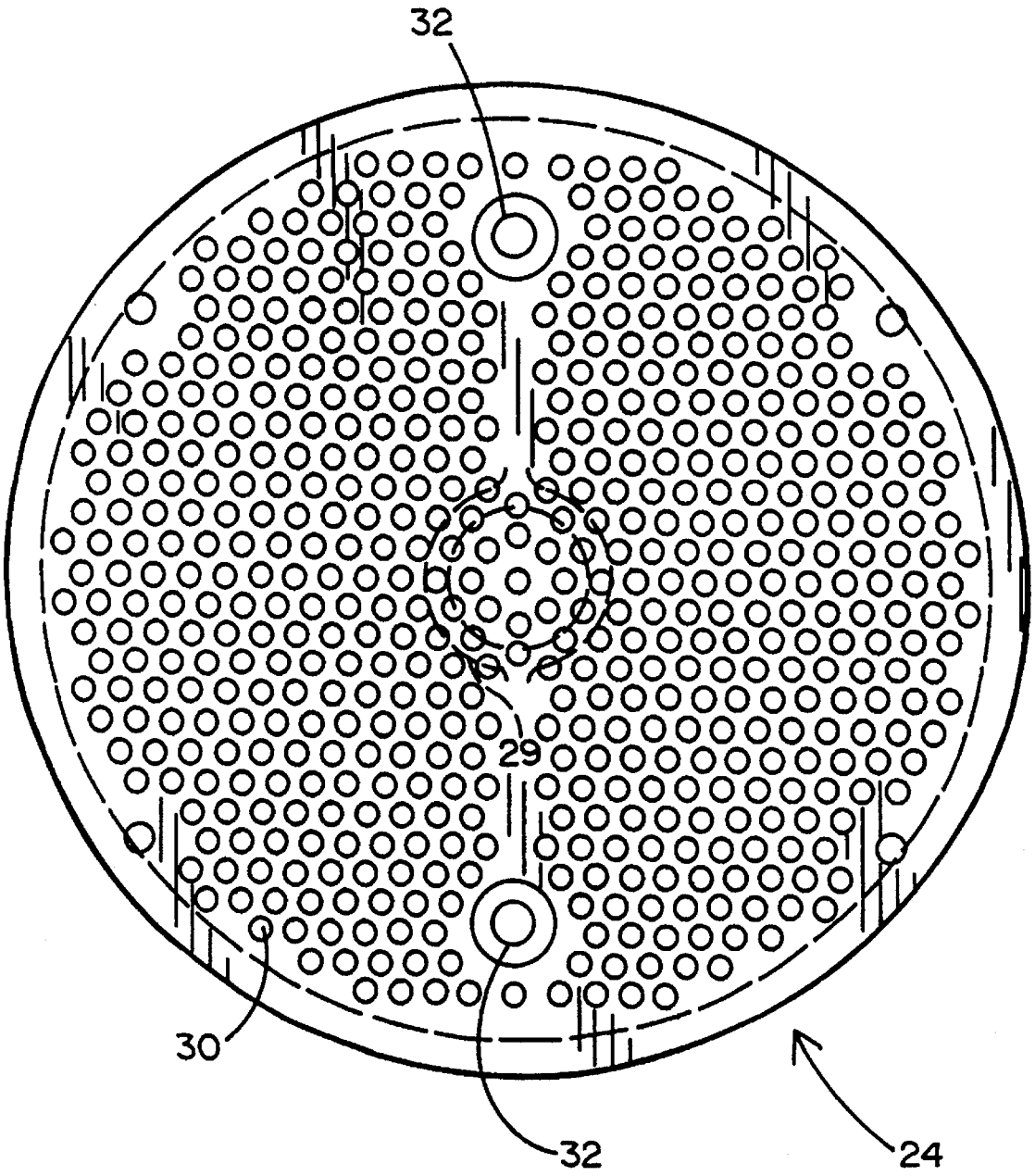
FIG. 2 is an elevational view of the aperture interface of is the present invention.

The face or cover 24 of the improved suction assembly 10 is shown in FIG. 2 where it will be seen that the face 24 comprises a large plurality of face apertures 30. Also shown therein are the two screws 32 which secure the face to the underlying threaded insert 25 shown in FIG. 1. Also seen in FIG. 2 is the partially hidden face tube 29, extending rearwardly from the opposed surface of the face 24.

Figure 3:
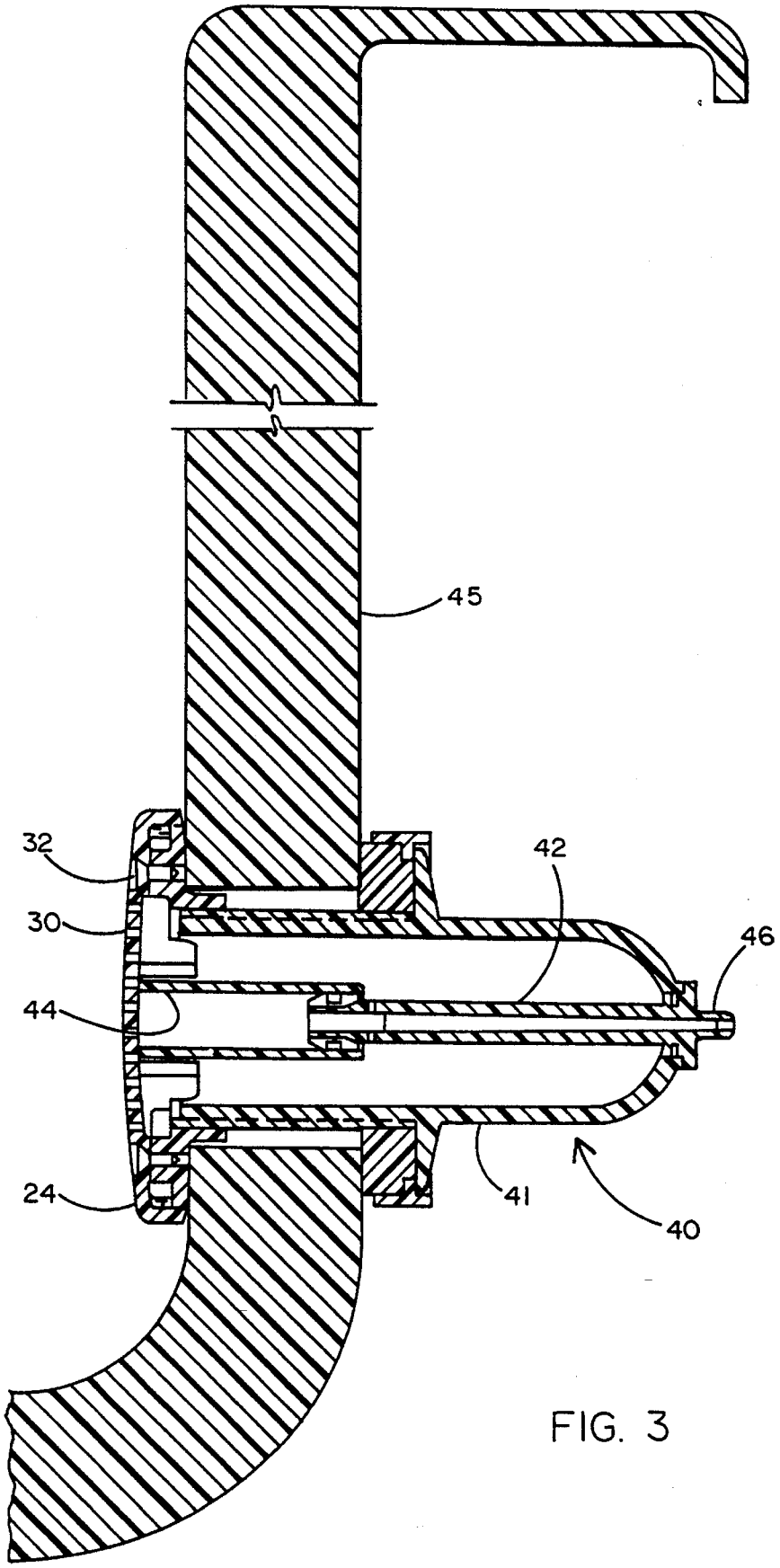
FIG. 3 is a cross-sectional view of the present invention shown installed in a thick-walled tub.

A second embodiment 40 of the improved suction assembly of the present invention is shown in FIG. 3. This second embodiment is substantially the same as the embodiment of FIG. 1, but is configured for installation into a thick tub wall 45, by using an elongated body 41 which uses a longer threaded section between flange 34 and threaded insert 25 to accommodate the additional thickness of the wall. Although the induction stem 42 is substantially the same as induction stem 27 of the first embodiment and although the face tube 44 is substantially the same as the face tube 29 of the first embodiment, because of the additional length in the body 41 as compared to the body 26 of the first embodiment, the degree of coaxial overlap between the face tube and the induction stem is markedly reduced. In addition, the channel within the induction stem 42 is tapered slightly toward a connector 46 which is adapted to interface with an induction tube in the manner disclosed in FIG. 1.

Figure 4:
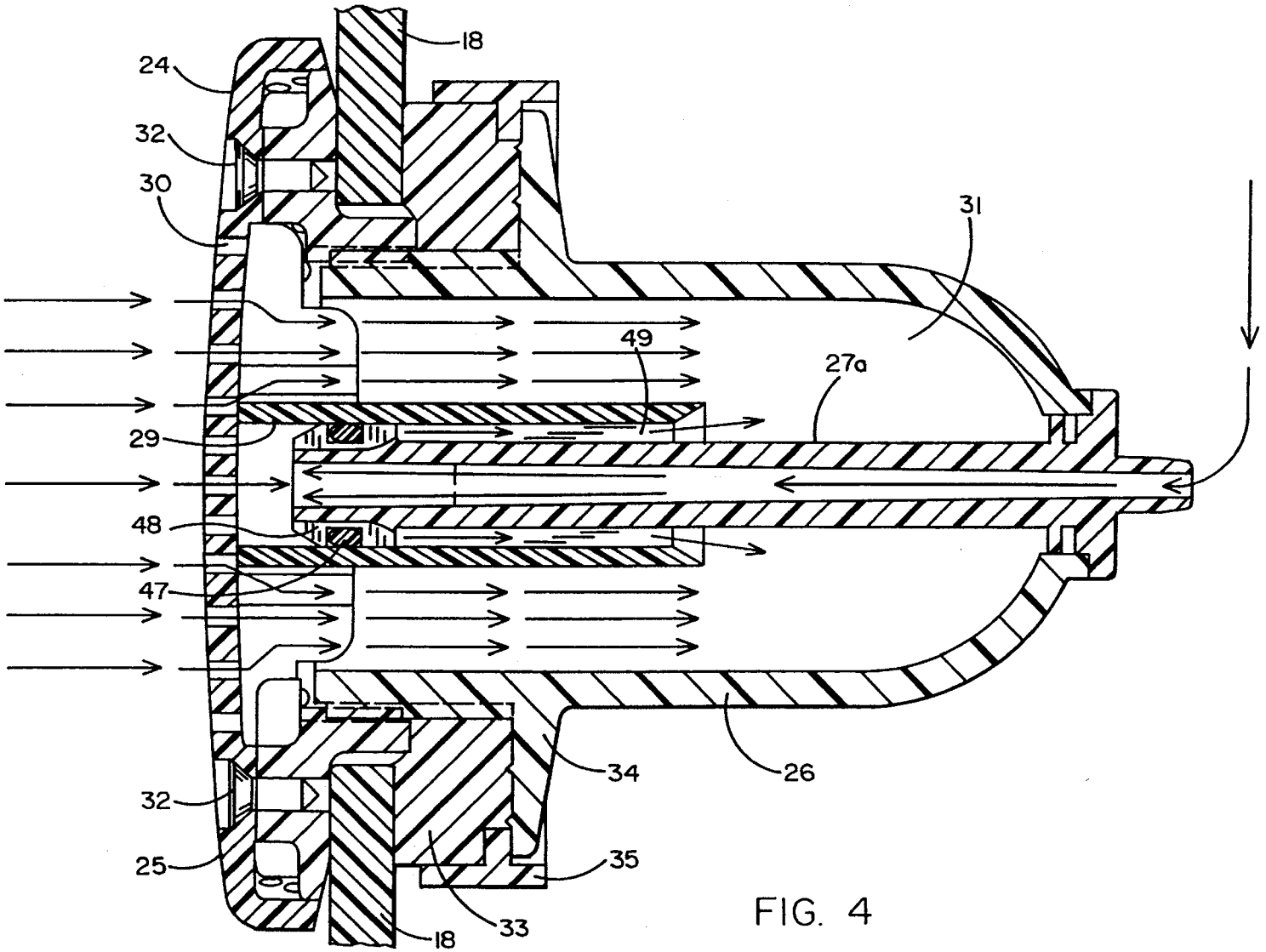
FIG. 4 is an enlarged cross-sectional view of the present invention illustrating the flow characteristics thereof during normal operation of the suction fitting with the suction cover being unobstructed.
Figure 5:
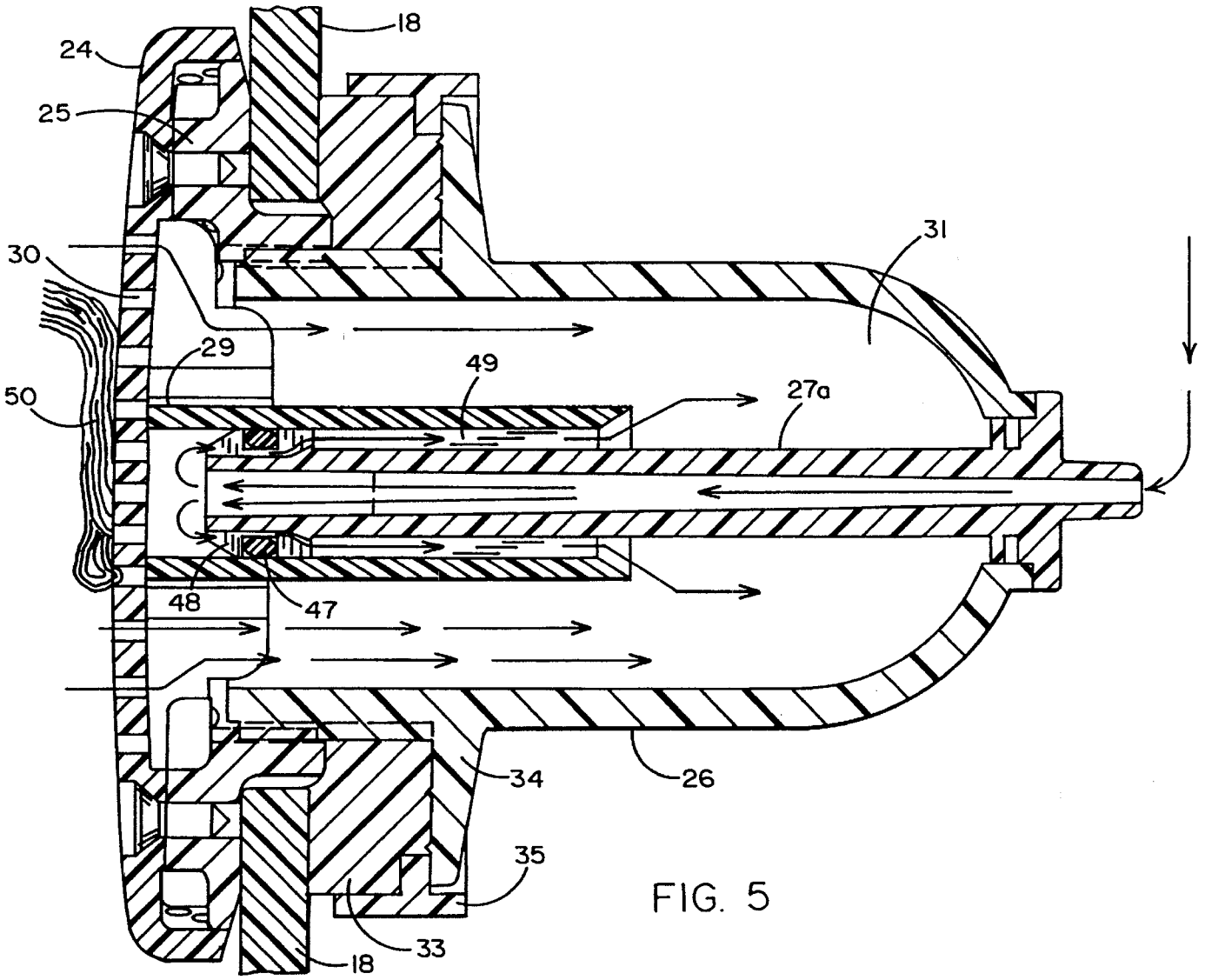
FIG. 5 is a view similar to that of FIG. 4, but illustrating the flow characteristics of the invention with the suction cover obstructed.

The flow characteristics of the improved suction assembly of the present invention may be best understood by referring to FIGS. 4 and 5, which illustrate those characteristics for two distinct conditions. The first condition, which is depicted in FIG. 4, corresponds to normal operating conditions when the face or cover 24 is unblocked. FIG. 5 corresponds to the condition of flow within the suction assembly when at least the central portion of the face or cover 24 of the suction assembly is blocked by a material such as human hair. In both FIGS. 4 and 5, the pump inlet pipe 15 is omitted for purposes of minimizing the complexity of the drawings. However, it will be understood that the body 26 of the assembly shown in each FIGS. 4 and 5 is connected to an inlet pipe 15, such as that shown in FIG. 1.

Referring now first therefore to FIG. 4, it will be seen that normal operation, without blockage, provides water flow from the interior of the tub through the cover 14 and into the main chamber 31 of the body 26. Water flowing through those face apertures 30 which are radially outward of the face tube 29, flows directly into the main chamber 31 while water flowing through the apertures 30 radially inward of the face tube 29, flows into the region between the face tube 29 and the induction stem 27, establishing a positive pressure head at the open mouth of the induction stem 27. Water in this region then flows through at least one forward bleed path channel 48 and a rear channel 49 into the main chamber 31 of the body 26. It will be seen in FIGS. 4 and 5 that forward channel 48 and rear channel 49 are sequential channels formed between the face tube 29 and the induction stem 27. It will also be seen that the forward channel 48 is separated from the interior surface of the face tube 29 by an O-ring 47. The purpose of O-ring 47 is to control the size of the forward channel 48 to a relatively small orifice area with a very low flow coefficient, limiting the bleed flow rate through the channel 48. In fact, the forward channel orifice is significantly smaller (i.e., one-tenth) than the size of the larger orifice areas of the face apertures 30 which have a relatively high flow factor, producing a flow rate that is larger than the bleed rate through the channel 48. As a result, a significant pressure head is formed at the opening of the induction stem 27, immediately behind the face or cover 24, within the radial perimeter of the face tube 29. This pressure head balances the pressure formed by the column of fluid that is present within the interior of the induction stem 27 and the connected induction tube which extends to the top of the tub as shown in FIG. 1.

Consequently, during normal operation and without obstruction of the cover 24, a column of water is always contained within the induction stem and the induction tube, so that only water reaches the pump inlet pipe and the pump operates normally. However, as shown in FIG. 5, when the face cover is obstructed, such as by blocking material 50, which may for example be human hair, water flow through the apertures 30, particularly within the radial perimeter of the face tube 29 is substantially or fully blocked. This blockage reduces the pressure head to zero or close to zero in the region between the opening of the induction stem 27 and the interior surface of the face cover 24, thereby permitting the column of water within the induction stem 27 and the attached induction tube to be drawn out and through the forward channel 48 and the rear channel 49, into the main chamber 31. This reduction in pressure head permits the induction stem 27A and attached induction tube to be drained of water. This can occur even when the remaining face apertures 30 radially exterior of the face tube 29, remain unblocked or substantially unblocked, allowing water to flow through those apertures, into the main chamber 31 and through the pump. However, as soon as the induction stem 27 and the attached induction tube are emptied of water, air then flows through the induction tube and the induction stem and that air is sucked through the forward channel 48 and the rear channel 49, into the main chamber 31 and the pump inlet. The introduction of air into the pump inlet causes the pump to cease proper operation. The pump pressure subsequently falls until there is little or no suction all along the interior surface of the face 24. At this point, there is no longer a force holding the material 50 against the suction assembly and the hair or other material that had been blocking the face cover 24 can then be readily withdrawn, unblocking the face. Once the material is withdrawn, the pressure head can then be gradually rebuilt to a sufficient degree to form a new column of water within the induction stem 27 and the attached induction tube, blocking air into the pump and allowing the system to resume normal operation as depicted in FIG. 4.

Thus, unlike the prior art, the present invention provides a suction assembly configuration which is adapted to cause the attached pump to cease normal operation when the face cover of the assembly is blocked. Furthermore, the present invention, unlike the prior art, accomplishes this pump control without requiring the use of a slot or a plurality of slots in the face cover 24 which would otherwise detract from the appearance thereof and increase the difficulty of manufacturing. More importantly, the present invention is designed to cause the pump to cease normal operation and release the blockage at the face cover 24, without the use of moving parts and thus without the potential reliability risks associated with utilizing moving parts or electrical or magnetic switches.

Those having skill in the art to which the present invention pertains, will now as a result of the applicant's teaching herein, perceive various modifications and additions which may be made to the invention. By way of example, the specific geometry and dimensions represented by the drawings herein, may be readily altered without sacrificing the numerous advantages described herein. Accordingly, all such modifications and additions are deemed to be within the scope of the invention which is to be limited only by the appended claims and their equivalents.

We claim:

1. A spa or whirlpool bath suction assembly comprising:

a body having a main chamber and an induction chamber, an integral pump inlet pipe connected to said main chamber and an induction tube connected to said induction chamber;

a face connected to said body, said face having a plurality of suction apertures providing passages for water flow into said body and into said pump inlet pipe, said face having an integral face tube extending into said body in overlapping coaxial relation to said induction chamber and forming a bleed path therebetween.

2. The suction assembly recited in claim 1 wherein said induction tube is connected to an air filter.

3. The suction assembly recited in claim 1 wherein said face comprises a smooth surface.

4. The suction assembly recited in claim 1 wherein the flow rate between said face apertures and said induction chamber is at least ten times greater than the flow rate in said bleed path.

5. The suction assembly recited in claim 1 further comprising a seal positioned between said bleed path and said face tube.

6. A suction assembly connected through an aperture in a wall of a whirlpool bath or spa tub below the water in the tub and connected to an inlet of a pump used for recirculating the water and propelling the water through a plurality of whirlpool bath jets; the assembly comprising:

a face on the inside of the tub wall, the face having a plurality of apertures through which the recirculated water flows into the assembly and into the inlet;

a body on the outside of the tub wall and connected to said face through said aperture, said body having a main chamber connected to said inlet and an elongated induction chamber open to ambient through an induction tube extended toward the top of the tub;

said face further having a tube extending through said tub wall aperture, exterior of said tub in overlapping coaxial relation to said induction chamber and forming a bleed path therebetween, whereby pressure in said face tube forming a column of water in said induction tube during normal operation of said suction assembly and whereby blockage of said face reduces said pressure and empties said column of water thereby permitting air to enter said pump inlet and cease said circulation.

7. The suction assembly recited in claim 6 wherein said induction tube is connected to an air filter.

8. The suction assembly recited in claim 6 wherein said face comprises a smooth surface.

9. The suction assembly recited in claim 6 wherein the flow rate between said face apertures and said induction chamber is at least ten times greater than the flow rate in said bleed path.

10. The suction assembly recited in claim 6 further comprising a seal positioned between said bleed path and said face tube.

* * * * *